United States Patent [19]

Gray et al.

[11] Patent Number: 4,535,838

[45] Date of Patent: Aug. 20, 1985

[54] HEAT EXCHANGE COIL AND METHOD OF MAKING

[75] Inventors: David A. Gray; Donald O. Webb, both of Tyler, Tex.

[73] Assignee: American Standard Inc., New York, N.Y.

[21] Appl. No.: 549,093

[22] Filed: Nov. 7, 1983

[51] Int. Cl.[3] ..... F28F 1/10; F28F 9/26; F28F 19/00

[52] U.S. Cl. ..... 165/134 R; 165/144; 165/163; 165/176; 62/507

[58] Field of Search ..... 62/507, 508; 165/144, 165/163, 172, 175, 125, 126, 134 R, 176

[56] References Cited

U.S. PATENT DOCUMENTS

| | | | |
|---|---|---|---|
| 2,023,749 | 12/1935 | Smith | 165/144 |
| 2,044,832 | 6/1936 | Child | 165/125 |
| 3,499,484 | 3/1970 | Lanzoni | 165/176 |
| 3,759,321 | 9/1973 | Ares | 165/125 |
| 4,143,816 | 3/1979 | Skadeland | 165/163 |
| 4,253,225 | 3/1981 | Wright et al. | 165/163 |

FOREIGN PATENT DOCUMENTS

| | | | |
|---|---|---|---|
| 0085381 | 8/1983 | European Pat. Off. | 165/163 |
| 2754101 | 7/1978 | Fed. Rep. of Germany | 165/125 |
| 3205359 | 8/1983 | Fed. Rep. of Germany | 165/163 |
| 783681 | 9/1957 | United Kingdom | 165/163 |
| 2017895 | 11/1979 | United Kingdom | 165/176 |

*Primary Examiner*—William R. Cline
*Assistant Examiner*—John K. Ford
*Attorney, Agent, or Firm*—Ronald M. Anderson; Carl M. Lewis; William J. Beres

[57] ABSTRACT

A multi-circuit arrangement for a wound coil heat exchanger and a method for making it are disclosed. The coil circuits are wound from a continuous length of spine fin tubing; locations are determined for breaking into the wound, continuous length of tubing to form adjacent circuits; the tubing is cut; the cut ends are pulled toward the manifold and downwardly so that adjacent ends angle toward each other; and transition tubes are secured to the cut ends, the tubes crossing each other to form an "X" configuration.

13 Claims, 8 Drawing Figures

HEAT EXCHANGE COIL AND METHOD OF MAKING

BACKGROUND OF THE INVENTION

1. Technical Field

The present invention pertains broadly to the field of heat exchangers, and specifically to wound, spine fin coil type heat exchangers having multi-circuits.

2. Prior Art

Helically wound fin tube coils are frequently used for outdoor heat exchangers in air conditioning units including cooling-only units and heat pumps. The wound coils provide an adequate heat exchange surface for the outdoor heat exchanger in an acceptable size, and can be relatively inexpensively manufactured, particularly for residential size units. The outdoor heat exchanger of the air conditioner frequently includes a plurality of circuits, and the coil may be wound in generally rectangular or annular shapes. The coil is disposed on a frame or base, with a guard disposed therearound and a cover or grill disposed on the top thereof for protection, the guard, cover and base essentially defining the perimeter of the outdoor unit. Arranged within the space defined by the coil of conventional units are the compressor, outdoor fan, inlet and outlet manifolds, expansion valves, check valves, filters driers and, in a heat pump, a reversing valve, with appropriate interconnecting refrigerant lines therebetween. A compact outdoor unit is thus provided, requiring only hookup to the indoor heat exchanger and an electric power source.

Typical manufacturing methods for such coils include winding the entire coil, either vertically or horizontally, from a continuous length of fin tubing, and thereafter determining in which wraps inlets and outlets for adjacent circuits should be made. Two cuts are made, and a section of tubing is removed from each wrap which is determined to be a location for circuit ends. Transition tubes leading to the manifolds are connected to the cut ends of the heat exchange tubing. The sections of fin tubing are removed to allow adequate space for the manifolds and for the transition tubes to be disposed at a downward angle from the circuit ends. Since the fin tube of the coil is often made of aluminum while the refrigerant lines are copper, the downward slope of the transition tubes is necessary to permit water to flow away from the aluminum to prevent corrosion from a galvanic reaction. The transition tubes are pretinned copper tubes having tapered ends which are inserted into the ends of the circuits and soldered in place.

In rectangularly shaped coils the spacing for manifolds usually has been achieved by removing a section of heat exchange tube which extends around a corner of a wrap, and the manifolds are provided one along each of two adjacent coil sides. The tube section removed is wasted in both economic and heat exchange efficiency terms. When a coil contains relatively long circuits few in number the amount of waste is insignificant. More recently however, in striving for increased efficiency for heat pumps or cooling-only air conditioners, it has been found desirable to increase the heat exchange capacity of the outdoor coil. This can be achieved by increasing the number of circuits in the outdoor coil. The waste resulting from removing a section of each coil wrap in which a break is made for circuit ends becomes significant, amounting to as much as five percent (5%) of the total material in the coil. The need for adequate room for manifolds remains, and the actual requirement is increased as the number of circuits are increased. It becomes more difficult to arrange the manifolds, refrigerant lines and transition tubes to ensure that no copper tubes are located above aluminum tubes, and that all aluminum to copper connections are disposed angularly downward away from the aluminum tubes. Thus, manufacturing and assembly become more costly and more difficult, and heat exchange capacity is more significantly influenced in heat exchangers having increased numbers of circuits.

SUMMARY OF THE INVENTION

It is therefore one of the principal objects of the present invention to provide a heat exchange coil of the wound fin tube type which defines a space of adequate size for arranging a compressor, manifolds, valves and other devices therein for multi-circuit coils, and which provides an arrangement wherein galvanic corrosion is reduced by ensuring that aluminum to copper connections are disposed at an angle downwardly from the aluminum tube, yet which is of acceptable size for residential air conditioning units.

Another object of the present invention is to provide a helically wound heat exchange coil which makes efficient use of its surface for heat exchange purposes by maximizing heat exchange capacity for its size, and which minimizes material wastes occurring during the manufacturing process.

A further object of the present invention is to provide a method of making a spirally wound heat exchange coil which provides adequate separation between copper and aluminum components and which is more simple than previously used methods, thereby reducing assembly time and cost.

These and other objects are achieved in the present invention by providing a heat exchange coil in which the ends of adjacent circuits are crossed to form an "X" configuration leading to their respective manifolds. The manufacturing method includes helically winding the entire coil from a continuous tube, locating the wraps in which cuts should be made for separating the coil into circuits, cutting the tube and pulling the cut ends away from the wrap and downwardly, thereby angling the ends toward each other. Transition tubes are attached to the cut ends and crossed leading to the manifolds. This provides ample room for attaching each of the circuit ends to its manifold while ensuring that copper to aluminum connections angle downwardly from the aluminum and that no copper components are situated above aluminum segments. The "X" configuration eliminates material waste, thereby increasing the heat exchanger efficiency by obviating the need for removing a portion of the wound tube to make manifold connections, hence utilizing all of the tubing originally wound in the coil.

These and other objects will become apparent from the following detailed description and the accompanying drawings.

DETAILED DESCRIPTION OF THE PREFRRED EMBODIMENT

Figure 1:
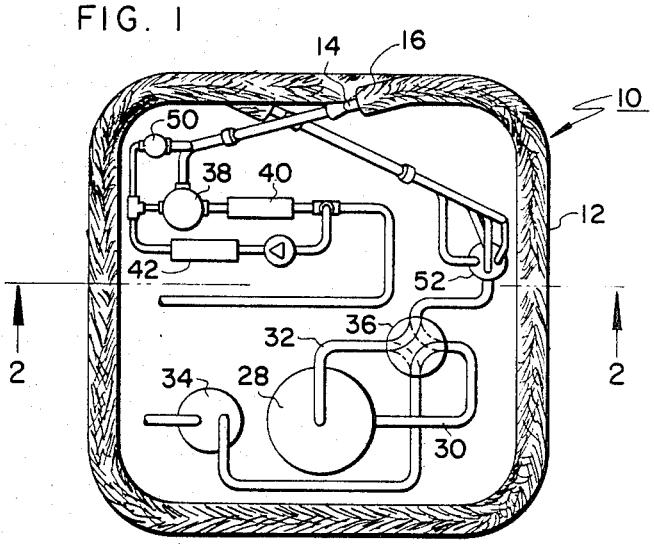
FIG. 1 is a top plan view of the outdoor unit of a heat pump having a heat exchange coil according to the present invention.

Referring now more specifically to the drawings, and to FIG. 1 in particular, numeral 10 designates the outdoor unit of a heat pump having a heat exchange coil 12 embodying the present invention. Coil 12 is made from a continuous length of heat exchange tubing including a central tube 14 and helically wrapped spine fin 16. Various methods are known for forming the finned tubing and for winding the tubing into round or rectangular shaped heat exchangers. The coil shown has been divided into four circuits spanning regions indentified by numerals 18, 20, 22, and 24 and a subcooling circuit spanning the region identified by numeral 26. It should be understood that the four circuits shown are only for demonstrative purposes, and any number of circuits may be used in a coil embodying the present invention. Further, the present invention can be used for coils in cooling only air conditioning units as well as in heat pumps as shown.

Situated within the space defined by the coil is a compressor 28 having a suction line 30 and a discharge line 32. Other conventional heat pump components disposed in the outdoor unit include an accumulator 34, a reversing valve 35 for reversing refrigerant flow for either heating or cooling operation, an expansion valve 38 for the outdoor coil when it is used as an evaporator, filter driers 40 and 42 and refrigerant lines interconnecting the aforementioned components. While none of the aforementioned heat pump components differ from those known in the art, a heat exchanger embodying the present invention provides ample space within the area defined by it for containing the components in a compact arrangement, and allows adequate access for assembly of the components during the manufacturing processes.

Heat exchange coil 12 includes manifolds 50 and 52 which direct refrigerant to and collect refrigerant from the various circuits of the coil. The upper end of each of the circuits is connected to manifold 50, and the lower end of each circuit is connected to manifold 52. It should be understood that the manifolds will function alternatively as inlet and outlet manifolds depending upon the operation of the coil as a condenser or as an evaporator.

Circuits 14, 16, 18 and 20 have upper circuit ends 54, 56, 58 and 60, respectively, and subcooler 22 has an upper end 62. Each of these are connected to the manifold 50 by way of a transition tube and a connecting tube, the transition tubes being designated with numerals 64, 66, 68, 70, and 72, respectively, and the connecting tubes being designated with numerals 74, 76, 78, 80 and 82, respectively. The lower ends of the circuits are designated with numerals 90, 92, 94, 96, and 98 and are connected to manifold 52 by transition tubes 100, 102, 104, 106 and 108 and connecting tubes 110, 112, 114, 116, and 118, respectively. Since the spine fin coils are generally made of aluminum and the tubing in the air conditioning unit other than the coils normally is made of copper, the transition tubes are used and the arrangement of components is made to prevent galvanic corrosion. The transition tubes are copper tubes having a tapered end which is inserted into the flared end of the aluminum coil circuit. Typically, the transition tube is pre-tinned and once inserted into the coil end is soldered in place. It is important that each of the transition tubes be tapered downwardly so that any moisture on the outside of the tube runs away from the aluminum tubing of the coil.

Figure 2:
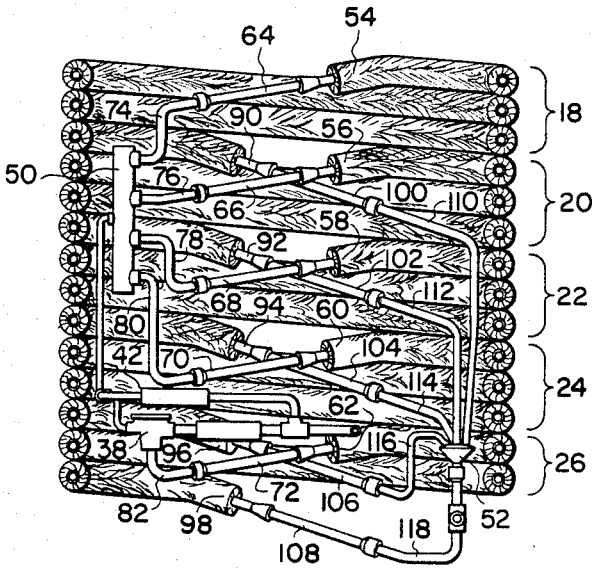
FIG. 2 is a cross-sectional view of the outdoor unit shown in FIG. 1, taken on line 2—2 of FIG. 1.

In previous heat exchangers of this type, a section of tubing was removed from each coil wrap which was broken for circuit connections, and the manifolds were positioned generally between the cut ends. As the number of circuits is increased, it becomes more difficult to position the manifolds, transition and connecting tubes in a proper arrangement to minimize galvanic corrosion. According to the present invention the transition tubes are allowed to cross each other, thereby forming an "X" configuration as they extend toward the manifolds. Crossing transition tubes of like material presents no problems involving galvanic corrosion even if the tubes touch, and all transition tubes are adequately spaced from aluminum tubes to negate any overlapping problems. Thus, the lower end transition tube of one circuit and the upper end transition tube of the next adjacent circuit following it are crossed during assembly. This can be clearly seen in FIG. 2 wherein transition tubes 66 and 100 from circuit ends 56 and 90 cross forming an "X" configuration as do transition tubes 68 and 102 from circuit ends 58 and 92 and transition tubes 70 and 104 from circuit ends 60 and 94. Additionally, lower end transition tube 106 from circuit 24 crosses with the upper end transition tube 72 of subcooler 26. Upper end transition tube 74 of circuit 18 and lower end transition tube 108 of subcooler 26, being the only circuit ends in their respective coil wraps, are not crossed with other transition tubes. Whereas in previous designs a substantial portion of the coil tubing had to be removed to allow room for the manifolds, which could amount to about five percent (5%) of the material in the coil, in the present invention none of the coil tube need be removed.

Figure 7:
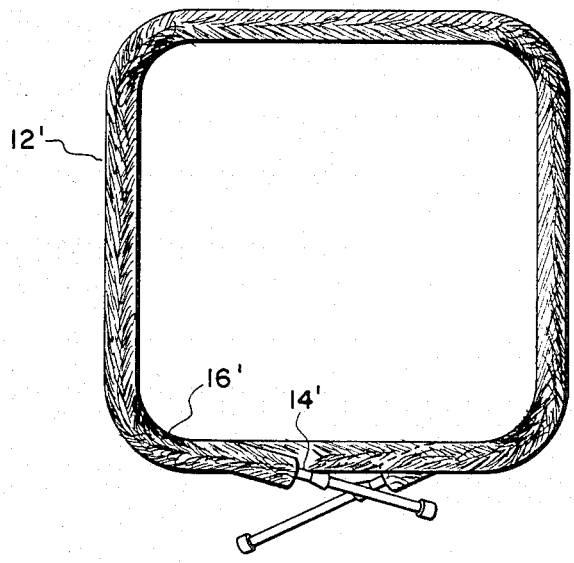
FIG. 7 is a top plan view of a modified form of a coil according to the invention.
Figure 8:
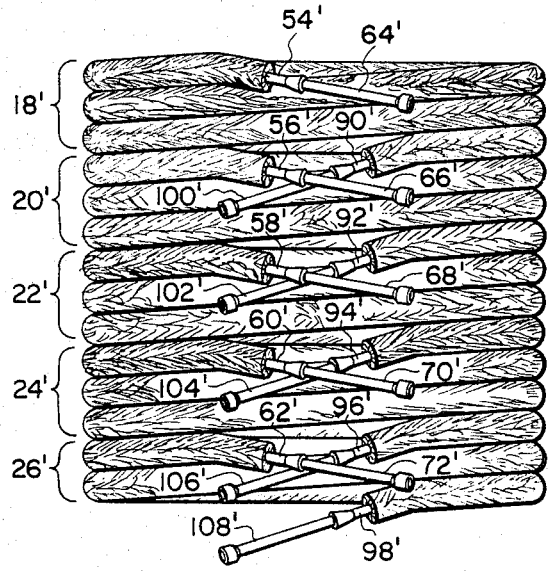
FIG. 8 is an elevational view of the coil shown in FIG. 7.

FIGS. 7 and 8, in which parts similar to previously described parts are designated with the same numeral as the previously described part but having a prime superscript, show a modified coil according to the present invention in which the manifolds are disposed on the outside of the coil. The cut ends of the heat exchange tube are bent outwardly and downwardly and are connected to the manifolds through transition tubes and connecting tubes as described previously. The only difference between the coil shown in FIGS. 7 and 8 and that of the previously described embodiment is that the manifolds, transition tubes and connecting tubes are disposed on the outside of the coil and not on the inside of the coil. The transition tubes are crossed as in the previous embodiment, and angle downwardly from the circuit ends.

Figure 3:
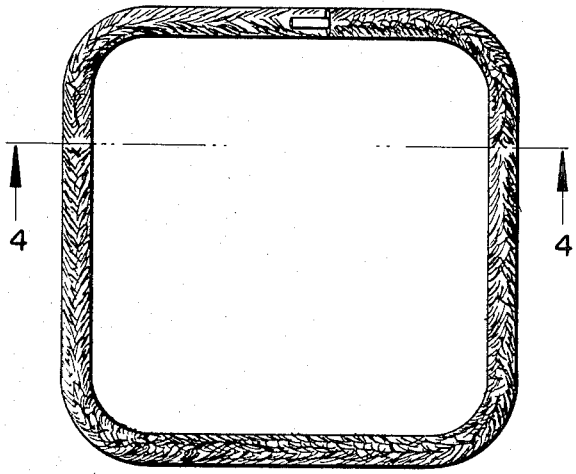
FIG. 3 is a top plan view showing a heat exchange coil during an early stage in the method of making a coil according to the present invention.
Figure 4:
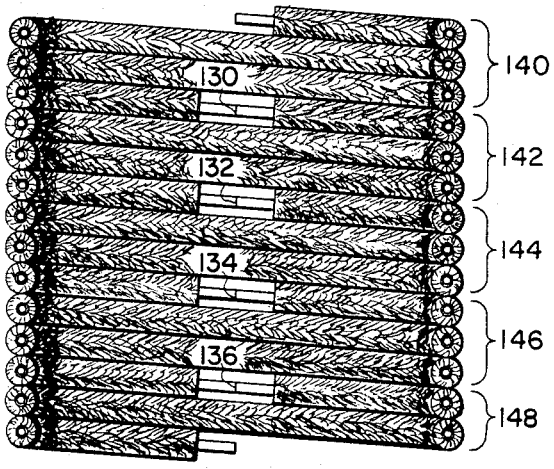
FIG. 4 is a cross-sectional view of the coil shown in FIG. 3 taken on line 4—4 of FIG. 3, and shows the coil after the locations for circuit ends have been determined and initial cuts made.
Figure 5:
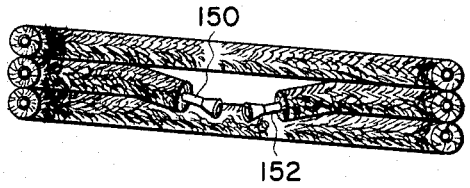
FIG. 5 is a fragmentary cross-sectional view of the coil shown in FIG. 4, depicting the coil at a later stage in the method of manufacture.
Figure 6:
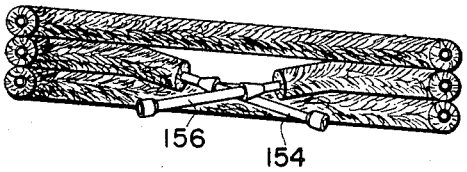
FIG. 6 is a fragmentary cross-sectional view of the coil as shown in FIG. 5, but depicting a later stage in the method of manufacture.

In manufacturing a coil according to the present invention, a continuous length of spine fin tubing is wound on a form to the desired configuration, such as the rectangular outline shown in FIG. 3. After the desired number of wraps have been formed for all of the circuits including any subcooler, the location for breaking the tubing to form the circuits is determined. In the example shown in FIG. 4 every third wrap was cut to form circuits; however, the number in each circuit may be varied. A small portion of the spine fin 16 is removed from tube 14, and the tube is cut. FIG. 4 generally shows a coil at this stage of manufacture, just after the cuts have been made in the coil wraps to divide it into individual circuits. A single cut is needed to form the lower end connection of one circuit and the upper end connection of the next adjacent circuit. In the drawing, cuts 130, 132, 134, and 136 are shown dividing the coil into circuits generally within regions identified by numerals 140, 142, 144, 146, and 148. After the cuts are made the tube ends are bent away from the coil and downwardly, angling toward a crossing point. If the manifolds are to be disposed on the inside of the coil, the circuit ends are bent inwardly and downwardly. If the manifolds are to be disposed on the outside of the coil the circuit ends are bent outwardly and downwardly from the coil wrap. The tube ends are flared, and transition tubes are inserted into the ends of the circuits, the transition tubes being crossed for circuit ends adjacent each other in the same coil wrap, and being attached such as by solder, adhesive or the like to the tube ends of the circuits. FIGS. 5 and 6 are fragmentary views showing a portion of a coil in later stages of manufacture. FIG. 5 shows the coil after the tube ends 150 and 152 have been bent and flared for receiving the transition tubes. The small section of fin material which is removed allows the cut ends of the tubes to project beyond the fins, leaving room for flaring the ends and for soldering the coil tube to transition tube joints. FIG. 6 shows the coil section after the transition tubes 154 and 156 have been attached. Connection of the transition tubes to the connecting tubes to the manifolds, and installation of the additional air conditioner outdoor unit components within the coil are then completed.

Although FIG. 4 shows all cuts for circuiting have been made before the tube ends are bent and transition tubes attached, it is not necessary to make the coil following that procedure. That is, the ends for each circuit can be bent immediately after the cut is made and before additional cuts are made. The transition tubes can be attached after each cut or after any or all cuts. Bending the tube ends may occur in stages; that is, a small bend may be made allowing attachment of transition tubes, and final bending for proper positioning and downward slope may be done after the transition tubes are attached.

Since the manifolds are not disposed between the cut ends of the coil, none of the coil tube need be removed to provide space for the manifolds. Waste in material and in heat exchange surface is eliminated. Crossing the transition tubes provides adequate separation of the connecting tubes to allow access for manufacturing assembly. Separation of the manifolds allows physical clearance of the tubes, and angling the tube downwardly insures that no copper tubing is located above connected aluminum tubing or coil, thereby preventing galvanic corrosion. The manifolds can be more strategically located within the unit, either inside the coil or outside the coil, thereby minimizing the lengths of copper connecting tubing required to make connections between the circuits and the manifolds and decreasing manufacturing costs. Manufacturing time has also been decreased in that only one cut is needed in the coil for each circuit. Previously two cuts were required for each circuit, to remove the required length of material between adjacent lower and upper circuit ends. A further manufacturing advantage is realized in that the connecting tubes to the manifolds and the transition tubes can be arranged in the proper sloping relationship in a straight forward, simple configuration which is easy for an assembler to understand and carry out. Assembly time and cost is minimized.

While one embodiment of a heat exchange coil and a method for making it have been disclosed in detail herein, it should be understood that various changes may be made without departing from the scope of the present invention.

We claim:

1. A heat exchanger coil for a multiple circuit heat exchange unit comprising:

a plurality of adjacent individual fin and tube coil circuits disposed vertically one above another, each of said individual circuits having a lower end and an upper end, the upper end of an individual coil circuit juxtaposed the lower end of the individual coil circuit disposed immediately above to form a pair of adjacent circuit ends in said heat exchange coil and the axis of each of said upper and lower circuit ends being skewed downwardly and away from the portion of the individual coil circuit from which said ends extend so that moisture on the exterior of said circuit ends flows downwardly and away from said upper and lower circuit ends;

a first manifold;

a second manifold; and means for connecting the upper end of each of said individual coil circuits to said first manifold and the lower end of each of said individual coil circuits to said second manifold, said connecting means intercrossed once for each of said pairs of adjacent upper and lower circuit ends said connecting means being fabricated from a metal dissimilar to the metal from which said coil circuits are fabricated.

2. The heat exchange coil according to claim 1 wherein said connecting means are tubes and at least a portion of each of said tubes extends downwardly in general axial alignment with one of said upper and lower circuit ends in said heat exchanger coil.

3. The heat exchange coil according to claim 2 wherein said tubes comprise a plurality of individual transition tubes and a plurality of individual connecting tubes, said plurality of transition tubes and said plurality of connecting tubes each being equal in number to the total number of upper circuit ends and lower circuit ends in said plurality of individual coil circuits, each of said transition tubes connected to and extending downwardly in general axial alignment with one of the upper and lower circuit ends in said heat exchange coil.

4. The heat exchange coil according to claim 3 wherein the individual transition tubes connected to adjacent pairs of upper and lower circuit ends cross in an X-configuration and wherein said individual connecting tubes are each connected both to an individual transition tube and to one of said first and second manifolds.

5. The heat exchange coil according to claim 1 wherein the tube portion of each of said plurality of individual fin and tube coil circuits, including the skewed upper and lower ends of each of said coil circuits, is of a length such that but for said upper and lower ends being skewed, said paired ends of adjacent individual coil circuits would be axially aligned and in direct communication.

6. A heat exchange coil for an air conditioning outdoor unit wound from a continuous length of finned tubing to form a desired configuration having a predetermined number of wraps, comprising: a plurality of helically wrapped coil circuits adjacently disposed vertically, each of said circuits including a tube and fins extending outwardly from the outer surface of said tube, the lower and upper ends of vertically adjacent circuits being disposed adjacent one another in one of said predetermined number of wraps, said adjacent ends being angularly disposed away from said coil and downwardly toward a crossing point so that moisture on the outside of a circuit end flows away from said end to prevent corrosion at said circuit end; a first manifold; a second manifold; and, a plurality of transition tubes fabricated from a metal dissimilar to the metal from which said coil circuits are fabricated, one of said plurality of transition tubes being attached to each of said adjacent circuit ends, said transition tubes being in flow communication with said first and said second manifolds for the upper and lower circuit ends respectively and the transition tubes of adjacent circuit ends for vertically adjacent circuits crossing to form an "X" configuration.

7. A heat exchange coil as defined in claim 6 in which said adjacent ends disposed angularly away from and downwardly from said coil are angularly disposed outwardly and downwardly away from said coil so that said transition tubes attached to adjacent circuit ends cross to form an "X" configuration outside of said coil.

8. A heat exchange coil as defined in claim 6 in which said adjacent ends disposed angularly away from and downwardly from said coil are angularly disposed inwardly and downwardly away from said coil so that said transition tubes attached to adjacent circuit ends cross to from an "X" configuration inside of said coil.

9. A heat exchange coil as defined in claim 6 in which said tube and fin are aluminum, and said transition tubes are copper.

10. A heat exchange coil as defined in claim 9 in which said transition tubes are partially inserted into said circuit ends.

11. A heat exchange coil as defined in claim 6 in which the tube of each circuit at each circuit ends projects past the end of the fin.

12. A heat exchange coil as defined in claim 11 in which said coil circuits are generally rectangular in shape and said ends of adjacent circuits are disposed on one of the sides of the rectangularly shaped coil.

13. A heat exchange coil as defined in claim 12 in which said upper ends of said circuits are in generally vertical alignment and said lower ends of said circuits are in generally vertical alignment.

* * * * *